US005305732A

United States Patent [19]

Wunning et al.

[11] Patent Number: 5,305,732

[45] Date of Patent: Apr. 26, 1994

[54] JACKETED JET RADIANT TUBE HEATER ENCLOSING A SEGMENTED FLAME TUBE HELD TOGETHER BY CLASPS

[75] Inventors: Joachim Wunning, Leonberg; Joachim G. Wunning, Aachen, both of Fed. Rep. of Germany

[73] Assignee: WS WarmeprozeBtechnik GmbH, Renningen, Fed. Rep. of Germany

[21] Appl. No.: 943,749

[22] Filed: Sep. 11, 1992

[30] Foreign Application Priority Data

Sep. 27, 1991 [DE] Fed. Rep. of Germany ..... 4132235

[51] Int. Cl.[5] ..... F24C 3/00

[52] U.S. Cl. ..... 126/91 A; 431/116; 431/215; 431/353; 285/187

[58] Field of Search ..... 431/115, 116, 350, 353, 431/158, 215; 126/91 R, 91 A, 82, 98, 92 C; 432/247; 60/39.32; 285/187, 133.1, 138, 41

[56] References Cited

U.S. PATENT DOCUMENTS 2,478,732 8/1949 Wilson et al. ..... 126/91 A
4,493,309 1/1985 Wedge et al. ..... 126/91 A
4,512,159 4/1985 Mennen ..... 60/39.32

FOREIGN PATENT DOCUMENTS 1551762 10/1972 Fed. Rep. of Germany .
2314118 10/1979 Fed. Rep. of Germany .
3447603C2 2/1987 Fed. Rep. of Germany .
716579 10/1954 United Kingdom .

*Primary Examiner*—James C. Yeung
*Attorney, Agent, or Firm*—Frishauf, Holtz, Goodman & Woodward

[57] ABSTRACT

A jacketed jet radiant heater for an industrial process furnace as a frame tube composed of axially aligned pipe pieces abutted on one another that are held together by clasps on the outside of the flame tube that have studs which protrude into holes in adjacent pipe pieces and have a head portion which serves to center the flame tube within the jacket tube. The clasps make it possible to provide exhaust gas releasing slots between some of the pipe pieces of the flame tube and thereby avoiding local overheating of the jacket tube.

25 Claims, 2 Drawing Sheets

JACKETED JET RADIANT TUBE HEATER ENCLOSING A SEGMENTED FLAME TUBE HELD TOGETHER BY CLASPS

This invention concerns a jacketed jet tube heater, suitable for the radiant heating of furnace chambers used for industrial processes, of the kind having a jacket tube (radiant heating tube) and a flame tube within the jacket tube. The flame tube has a burner at its input end and is of composite construction, being in the form of pieces of pipe axially aligned and having buttjointed flush ends and having pass-through combustion product gas channels which discharge into a channel of angular cross-section between the jacket tube and the flame tube, with the flame tube being centered in the jacket tube by means of spacers.

BACKGROUND AND PRIOR ART

It is known from British patent 716579 to make the flame tube of a jacketed jet tube heater of a number of hollow cylinderical ceramic parts disposed one behind the other and which are held together by interlocking ends of the hollow cylinderical ceramic parts as well as being cemented together. Such flame tubes are difficult to manufacture and are sensitive to unavoidable bending stresses that occur in operation.

In U.S. Pat. No. 2,478,732 a jacketed jet tube heater is disclosed in which a ceramic flame tube is likewise composed of pipe pieces or circular ring parts of which the terminal ring part adjacent to the end wall of the jacket tube is provided with radial passages for combustion product gas (hereinafter referred to as "exhaust gas") and, similarly, the other circular ring parts are provided on their outer surfaces outer surfaces with radial spacer ribs. These spacer ribs produce the centering of the flame tube in the radiant jacket tube and are for this purpose are supportive or held in place at their radially outer ends at the internal wall of the jacket tube. The circular ring parts, besides, are aligned flush to each other; they are pressed together tightly one against the other by springs acting against the free end of the column of circular ring parts which are supported by bearing against the end wall of the jacket tube. When this flame tube is used there remains a danger of local overheating of the radiant jacket tube in the regions of the exhaust gas channels discharging simply in the immediate neighborhood of the jacket tube end closure, whereas on the other hand, it is difficult to assure, at the butt joints of the flame tube's circular ring parts pressed together against each other only elastically, that there will be well defined flow relations and, likewise, to avoid that, in response to a bending stress of the flame tube, the abutments open up in a uncontrollable manner, with the result of producing local overheating of the radiant jacket tube.

In order to produce flame tubes disposed in jacket tubes with provision for flexibility required by bending stresses that arise in operation, it is also known from German patents 15 51 762 and 23 14 118 to produce flame tubes composed of segments consisting entirely or partly of ceramic materials. In these segments temperatures or slots forming exhaust gas channels through the material can be made. It is however also known to provide the exhaust gas channels at axis-parallel abutments of the circular ring segments with each other and to make these in such a way that they have a tangential direction component (German patent 23 14 118). For connecting pipe sections thus configured with each other overlapping muff connections (German patent 34 47 603) or bayonet joints can be used.

For increasing the service life of the jacket tube by which the heat output is radiated into the furnace, while taking into account $NO_x$ reducing precautions, a higher rate of circulation is necessary for hot exhaust gases flowing through the ring channel between the flame tube and the jacket tube, while at the same time a defined amount of heat transfer through the radiant jacket tube is to be produced with uniform temperature distribution over that tubes heat-delivering surface. The known ceramic radiant jacket tubes, because of the necessary flexibility, are composed of pieces of pipe or circular ring parts or segments. Either no definite flow relations are provided in the boundaries between parts abutting one upon the other or else the connection means used for the ceramic parts narrow down the already barely sufficient flow cross-section of the ring channel between the flame and jacket tubes and, moreover, additional material and expensive manufacturing methods are often required for these known flame tubes.

SUMMARY OF THE INVENTION

It is an object of this invention to avoid the above mentioned difficulties and to provide a jacketed jet tube radiant heater in which, with a simple shaping of the parts of the flame tube, a maximum flow cross-section for exhaust gas circulation is produced, thus obtaining with simple measures a flow guidance of the gas circulation which is in every respect suited to the operation of the heater.

Briefly, the pipe pieces of the flame tube which are aligned end to end are connected to each other by clasps. These clasps make possible an exact mutual disposition of the pipe pieces which remains preserved under operating conditions. The clasps are very preferably applied throughout to the outside of the pipe pieces, even though for special embodiments it can also be useful to provide internal clasps.

It is important that the clasps can be provided in a form acting as spacers, thus making available an optimal possibility of fitting to a variable jacket tube diameter with constant flame tube diameter. Moreover, at least two pipe pieces can be disposed with axial spacing from each other with provision of a slot operating as an exhaust gas channel. By corresponding dimensioning of the width of these slots and by corresponding choice of their distribution over the length of the flame tube there is made available the possibility of providing with very simple means a precisely predetermined guiding of the exhaust gas flow through defined slots and to provide zones of improved heat transfer.

Such purposely selected slots of greater width produced by corresponding features of the configuration of the clasps make it possible to affect favorably the temperature distribution and the circulation flow. In this way those regions of excessive temperature can be avoided which usually arise in the region of gas flow reversal of direction at the end of a closed jacket tube.

It has also been found desirable for the end surfaces of the pipe pieces to be oblique and such that the sloping surfaces of neighboring pipe pieces are somewhat similarly sloped. It has been found that particularly with oblique pipe end surfaces there is no overheating in the region of the necessary small slots between neighboring pipe pieces which are required for flexibility. The small slots have a width in the region of one millimeter. They have no effect on the circulation flow.

At least a portion of the pipe pieces can carry protrusions on the outside for increasing the heat-disipitating surface. These could be of rib-like configuration. The resulting increase of the heat transferring surface and the resulting stronger turbulence of the hot gas flow can improve the heat transfer in certain regions.

In a preferred embodiment the clasps are brackets of a kind resembling lasts which are connected to the pipe pieces by means of closely fitting holding means. These holding means may be stud-like holding elements which are inserted into corresponding holes in the wall of the pipe pieces and/or in the body of the brackets. It has been found to be desirable for the stud-shaped holding elements each to have a widened head part, so that they can serve at the same time for centering the flame tube in the jacket tube. Thus, the corresponding dimensions of the head part these studs can be selected to fit into the inside diameter of any particular radiant jacket tube.

The pipe pieces, the clasps and their holding means may consist at least in part of ceramic material. They can be manufactured in simple shapes, as is also the case with the pipe pieces and/or the clasps and/or their holding means. They can also be made, wholly or in part, of heat resistant metal, for example, a special alloy having heat resistant properties.

Finally, the clasps above mentioned may be used to hold not only the several pipe pieces together one with another, but also to hold the entire flame tube itself to a burner (flame generator) located upstream of it.

BRIEF DESCRIPTION OF THE DRAWINGS

The invention is further described by way of illustrative example with reference to the annexed drawings, in which.

DESCRIPTION OF THE ILLUSTRATED EMBODIMENT

Figure 1:
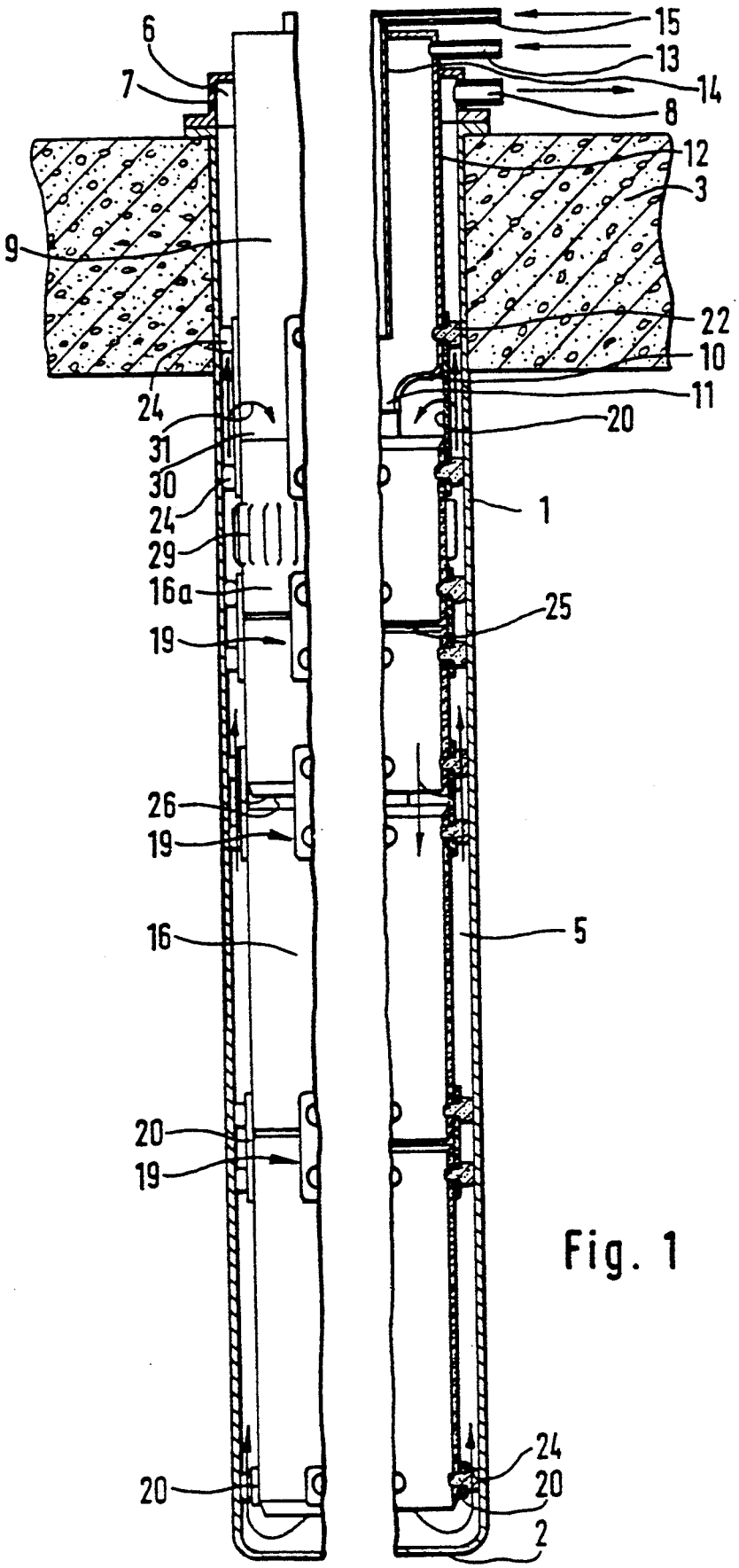
FIG. 1 shows a jacketed jet tubular radiant heater according to the invention in a section passing through the axis of the heater designated I/I of FIG. 3, with the left hand half of the flame tube and burner being shown in side elevation.

The jacketed jet radiant tube heater shown in the drawings serves particularly for heating of furnace chambers for industrial processes. It has a cylindrical jacket tube 1, which is closed at one end at 2. In the region of its other end it is set in and sealed to the wall 3 of a furnace chamber that is not further shown. A coaxial cylindrical flame tube 4 is disposed within the jacket tube so as to define, together with the internal wall of the jacket tube 1, a ring channel 5 extending over the length of the flame tube. That ring channel extends further, outside of the burner 9 into an exhaust gas collecting base 6 contained within an annular cap 7 capping the jacket tube and having an outlet fitting 8 for leading away the combustion product gases from the gathering space 6.

The burner 9 is disposed in the jacket tube 1 coaxially with the flame tube 4 and has a combustion chamber 10 protruding into the flame tube 4. The burner 9 also has a burner nozzle 11 through which a flame enters into the flame tube 9. Above the combustion chamber 10 there is shown a connecting air supply cylinder for the combustion air which is introduced through a fitting 13 into the air supply cylinder 12. The fuel supply is provided by a coaxial fuel lance 14 discharging into the combustion chamber and connected to a fuel inlet fitting 15.

Figure 2:
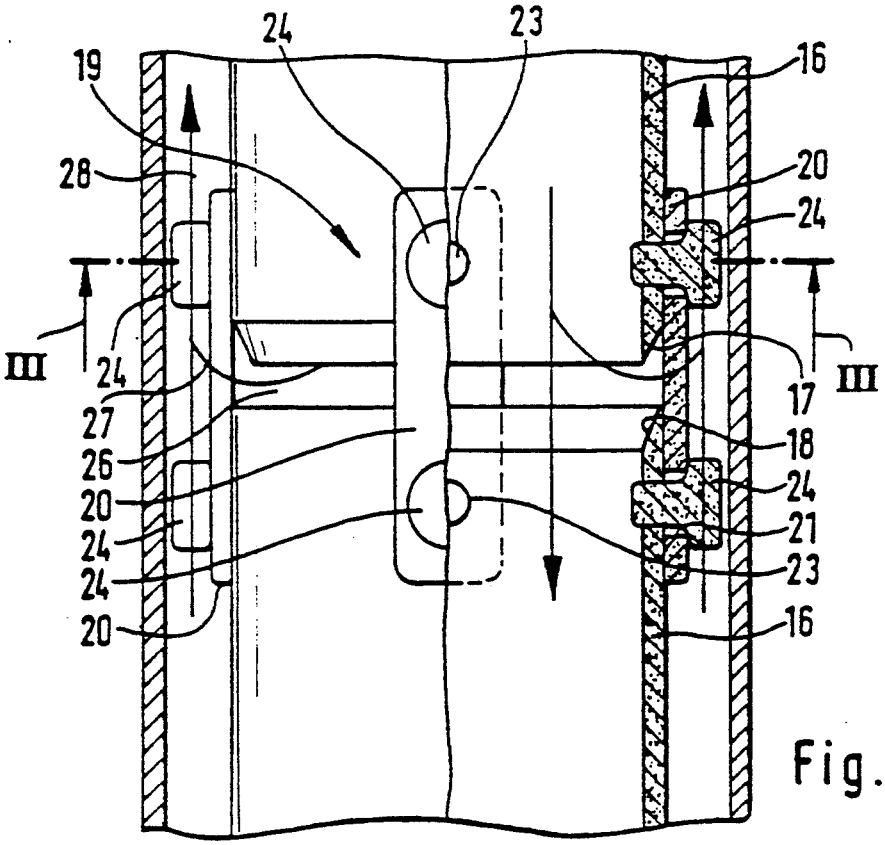
FIG. 2 shows, on an enlarged scale, a middle portion of the heater of FIG. 1.

The cylinderical flame tube 4, which discharges at a location spaced a little from the end wall 2 of the jacket tube, is composed of individual cylindrical pipe pieces 16 which are preferably of ceramic material and are disposed in a succession, 5 bearing one against the other. The pipe pieces 16 have the same inner diameter and the same outer diameter. Their axial lengths can be different. In the region of their end surfaces the pipe pieces 16 are in every case provided with a chamfer bevel, shown at 17 and 18, which extends around the end of the pipe piece. In each case one of two adjacent pipe pieces has an external chamfer 17 while the other has an internal chamfer 18. In each case chamfers of neighboring pipe pieces are directed in the same direction where they face each other, as is also shown in FIG. 2.

The coaxially aligned pipe pieces 16 are connected to each other by clasps 19 which are applied externally to the pipe pieces 16 and are located in the ring channel 5. In the illustrated example there are four of them for each connection, which are evenly spaced around the circumference of the pipe pieces connected together. It is, of course, not necessary that there should be just four of them: in principle more or fewer clasps 19 could be provided for each joint according to the conditions of the individual case.

Figure 3:
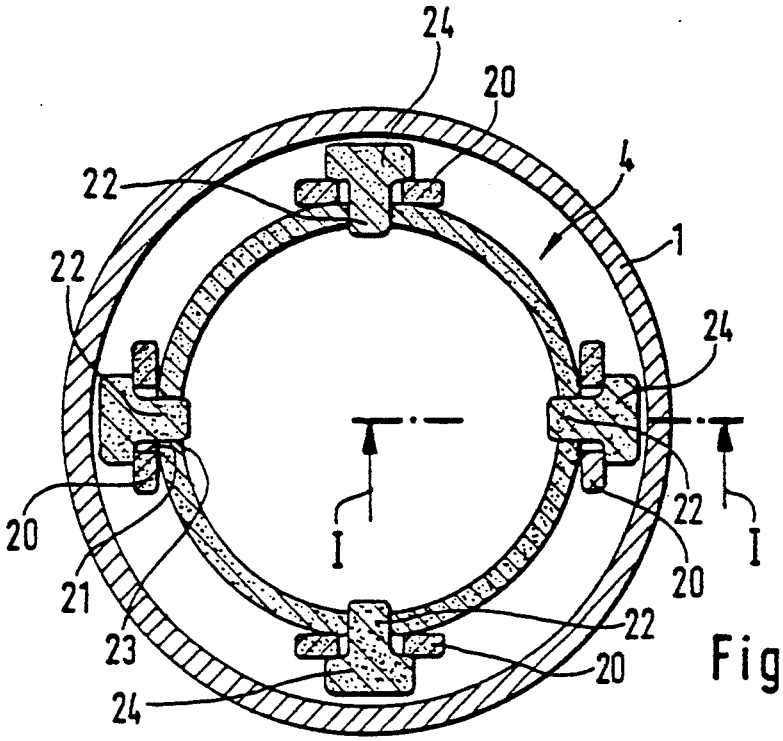
FIG. 3 is a cross-section of the heater mid-portion of FIG. 2 which passes through the horizontal plane drawn through the line III—III of FIG. 2, seen from above.

Each of the clasps 19 has a narrow elongate last-like bracket 20, which is perforated in the region of each end with a hole 21 (FIG. 3), through which a holding stud 22 protrudes and is inserted into the corresponding hole 3 in the wall of a pipe piece 16. FIG. 3 shows that the brackets 20 have parallel edges and plane surfaces, as is adequate for larger outer diameters of the pipe pieces 14. Especially in the case of smaller outer diameters of the pipe pieces 16 it can be useful to provide curved bracket surfaces by using sections made from a cylindrical segment for fitting the outer circumference of the pipe pieces 16. The brackets 20 are disposed with their length essentially parallel to the axis of the flame tube 4 in order to produce the least possible flow resistance for the gases flowing through the ring channel 5. Their disposition and configuration, however, can also be so provided that they have the effect of directional guidance for the exhaust gas flow, somewhat in the sense of generating a spiral flow configuration.

Each of the studs 22 is provided with a widened head part 24 that lies against the corresponding bracket 20 and has an axial height chosen so that the studs 22 directly operate as spacing means which center the flame tube 4 in the surrounding jacket tube 1. By the selection of studs 22 with corresponding heights of the head part 24 a fit can be obtained with a jacket tube 1 having a varying diameter while the diameter of the flame tube is constant. Since the studs 22 can be simply assembled with the brackets 20 and the pipe pieces 16, after which the entire completed assembly is held together unreleasably by the surrounding jacket tube 1, simple manufacturing and assembly procedures are usable for the flame tube 4. Individual pipe pieces 16 can readily be replaced by spare pieces in case of need. Furthermore, the clasps 19, because of their stiff and closely fitting attachment to the pipe pieces that are to be connected together, make possible a trouble free and precisely positioned mutual fixation of the pipe pieces 16 connected to each other.

Neighboring pipe pieces 16 can, by corresponding arrangement of the holes 23 provided for the seating of the studs 22, be arranged in substantially direct abutment with each other, in such a way that the neighboring chamfers 17 and 18 overlap each other and at the joint there remains only a small slot 25 (FIG. 1) necessary for the flexibility of the flame tube 4. The width of such a slot 25 can be more or less approximately 1 millimeter. This small slot 25, particularly also because of the chamfers 17 and 18, has no influence on the circulation flow produced in the ring channel 5. It also does not generate local overheating of the jacket tube 1 in the vicinity of the slot.

The clasps 19 also make it possible to provide a larger slot 26 designedly between particular neighboring pipe pieces by a simple change of the location of their holes 23. A larger slot having an exactly defined width operates as an exhaust gas channel. By corresponding arrangement and dimensioning of these slots 26, by which the outward exhaust gas flow occurs which is shown at 27 in FIG. 2, it is possible to influence the temperature distribution over the length of the jacket tube and to maintain a favorable exhaust gas circulation established in the ring channel 5. For this purpose, also. similarly directed chamfers 17 and 18 of every slot 26 could be so directed that the exhaust gas flow out of the inside of the flame tube 4 maintain a flow component directed in the direction of the circulation flow designated by the arrows 28.

The pipe pieces 16, brackets 20 and/or studs 22, because of their simple shape, can be made of ceramic and/or heat resistant special alloys, i.e. of materials of which the shaping possibilities are inherently limited because of the desired material properties.

The ceramic pipe pieces 16, which for example consist of silicon carbide, can be smooth-walled on the outside, as is to be inferred from FIG. 1. It is also possible, at selected locations of the flame tube 4, however, to insert pipe pieces 16*a* (FIG. 1) which have protrusions formed on their external circumference, for example in the form of parallel longitudinal ribs 29, which improve the heat transfer to the exhaust gases flowing lengthwise along their exterior by increasing the heat transfer surface and by promoted turbulence.

The flexible flame tube 4 composed of the pipe pieces 16, 16*a* in the above described way is likewise connected to the burner 9 by means of clasps 19, of which the brackets 20 and studs 22 are visible in FIG. 1. The clasps 19 hold the pipe piece 16*a* at the end of the flame tube assembly at an axial spacing from the burner nozzle 11 which is such that through the ring gap 30 thus left open a relatively large flow of circulating exhaust gases can be sucked into the flame tube 4 by injector action, as indicated by the arrows 31.

In the embodiment above described the head portions of the studs 23, selected with respect to their axial height as above explained, are spacing means which center the flame tube 4 in the jacket tube 1. Basically, however, other embodiments can also be provided in which the brackets 20 carry spacing elements, for example molded-on humps or ribs which take over the task of centering.

In the special case mentioned above in which internal clasps are provided on the inside of the flame tube, centering of the flame tube in the jacket tube can be done by spacers affixed to the jacket tube or to the flame tube.

The jacket tube 1 can be made of steel, of ceramic, for example SiC, or of heat resistant special alloys (including sintered materials).

It will therefore be understood that although the invention has been described with reference to a particular illustrative example, variations and modifications are possible within the inventive concept.

We claim:

1. A jacketed jet radiant heater suitable for heating an industrial process furnace comprising a jacket tube (1), mounted, near one end thereof, in a furnace wall and closed at its other end, said jacket tube surrounding, at its furnace-wall end, a burner unit (9) mounted therein, and a flame tube (4) disposed within said jacket tube, said flame tube being aligned at one end with said burner unit so as to receive a flame therefrom and at its other end being positioned for discharging combustion product gas into said jacket tube near said closed end thereof, said flame tube being composed of axially aligned pipe pieces (16,16*a*) connected one to another in each case by a plurality of clasps, said clasps in some pipe piece connections spacing apart connected pipe pieces from each other for providing channels for exhaust gas flow between the inside of said flame tube and a ring duct (5) inside said jacket tube and outside said flame tube, said clamps (19) each having elements protruding perpendicularly into respective holes of pipe pieces respectively joined by a said clasp.

2. A jacketed jet radiant heater according to claim 1 wherein all said clasps are disposed externally on said flame tube.

3. A jacketed jet radiant heater according to claim 2 wherein said protruding elements of said clasps (19) also protrude towards said jacket tube and thereby center said pipe pieces in said jacket tube.

4. A jacketed jet radiant heater according to claim 3, wherein said clamps spacing apart connected pipe pieces (16,16*a*) produce the formation o a slot (26) between spaced-apart connected pipe pieces, said slot having the effect of an exhaust gas channel.

5. A jacketed jet radiant heater according to claim 4, wherein the end surfaces of said pipe pieces (16,16*a*) are obliquely inclined at a constant angle to the axis of the pipe piece to which they belong.

6. A jacketed jet radiant heater according to claim 5, wherein end surfaces of said pipe pieces which face each other from neighboring pipe pieces are inclined, at least approximately at the same angle to the respective pipe piece axis.

7. A jacketed jet radiant heater according to claim 3, wherein the end surfaces of said pipe pieces (16,16*a*) are obliquely inclined at a constant angle to the axis of the pipe piece to which they belong.

8. A jacketed jet radiant heater according to claim 7, wherein end surfaces of said pipe pieces which face each other from neighboring pipe pieces are inclined, at least approximately at the same angle to the respective pipe piece axis.

9. A jacketed jet radiant heater according to claim 3, wherein a portion (16*a*) of said pipe pieces, (16,16*a*) are provided with protrusions from the external surface of the surfaces of the respective pipe pieces which increase the heat dissipating surface of said portion of said pipe piece.

10. A jacketed jet radiant heater according to claim 9, wherein said protrusions (29) are of a rib-like shape.

11. A jacketed jet radiant heater according to claim 3, wherein said clasps are shaped after the fashion of a last and include an elongate plate and said protruding elements disposed near respective ends of said plate, each extending in opposite directions from opposite surfaces of said plate and the portion of each said protruding element which protrudes towards the inside said flame tube being shaped for fitting into a hole of a set of holes provided in the respective pipe piece.

12. A jacketed jet radiant heater according to claim 11, wherein each said portion of a said protruding element which protrudes towards the inside of said flame tube is in the shape of a pin-like stud and wherein said holes are apertures in said pipe pieces having a cross section fitting said pin-like studs.

13. A jacketed jet radiant heater according to claim 12, wherein said protruding elements pass through respective holes in a said plate and wherein on the side of said plate opposite that from which said pin-like studs protrude, each of said protruding elements includes a head portion which is wider than said pin-like studs.

14. A jacketed jet radiant heater according to claim 13, wherein said head portion (24) of each said protruding element is shaped and dimensioned for centering a pipe piece of said flame tube in said jacket tube.

15. A jacketed jet radiant heater according to claim 3, wherein said clasps are at least in part composed of a ceramic material.

16. A jacketed jet radiant heater according to claim 3, wherein said clasps are at least in part composed of a heat resistant metal.

17. A jacketed jet radiant heater according to claim 3, wherein said flame tube is connected with said burner unit with clasps of the same kind as are used for connecting said pipe pieces one to another.

18. A jacketed jet radiant heater according to claim 2, wherein at least two of said pipe pieces (16,16*a*) are held by a plurality of said clasps at a defined axial spacing from each other, with the formation thereby of a slot (26) having the effect of an exhaust gas channel.

19. A jacketed jet radiant heater according to claim 2, wherein the end surfaces of said pipe pieces (16,16*a*) are obliquely inclined at a constant angle to the axis of the pipe piece to which they belong.

20. A jacketed jet radiant heater according to claim 19, wherein end surfaces of said pipe pieces which face each other from neighboring pipe pieces are inclined, at least approximately at the same angle to the respective pipe piece axis.

21. A jacketed jet radiant heater according to claim 2, wherein a portion (16*a*) of said pipe pieces (16,16*a*) are provided with protrusions from the external surface of the surfaces of the respective pipe pieces which increase the heat dissipating surface of said portion of said pipe piece.

22. A jacketed jet radiant heater according to claim 21, wherein said protrusions (29) are of a rib-like shape.

23. A jacketed jet radiant heater according to claim 2, wherein said clasps are at least in part composed of a ceramic material.

24. A jacketed jet radiant heater according to claim 2, wherein said clasps are at least in part composed of a heat resistant metal.

25. A jacketed jet radiant heater according to claim 2, wherein said flame tube is connected with said burner unit with clasps of the same kind as are used for connecting said pipe pieces one to another.

* * * * *